United States Patent [19]

Sasayama et al.

[11] 4,201,161

[45] May 6, 1980

[54] CONTROL SYSTEM FOR INTERNAL COMBUSTION ENGINE

[75] Inventors: Takao Sasayama, Hitachi; Seiji Suda, Mito, both of Japan

[73] Assignee: Hitachi, Ltd., Japan

[21] Appl. No.: 950,572

[22] Filed: Oct. 12, 1978

[30] Foreign Application Priority Data

Oct. 17, 1977 [JP] Japan ..... 52-124262

[51] Int. Cl.[2] ..... F02D 5/00

[52] U.S. Cl. ..... 123/32 EB; 123/32 EE; 123/32 EH; 123/32 EL; 123/119 EC; 60/276; 364/431

[58] Field of Search ..... 123/32 EE, 32 EA, 32 EB, 123/32 EC, 32 ED, 32 EG, 32 EH, 32 EL, 119 EC; 60/276, 285; 364/424, 431, 442

[56] References Cited

U.S. PATENT DOCUMENTS

| | | | |
|---|---|---|---|
| 3,895,611 | 7/1975 | Endo et al. | 60/276 |
| 4,009,699 | 3/1977 | Hetzler et al. | 123/32 EB |
| 4,048,965 | 9/1977 | Bianchi et al. | 123/32 EA |
| 4,084,563 | 4/1978 | Hattori et al. | 123/32 EE |
| 4,122,811 | 10/1978 | Bowler et al. | 123/32 EB |
| 4,130,095 | 12/1978 | Bowler et al. | 123/32 EE |

*Primary Examiner*—Ira S. Lazarus
*Assistant Examiner*—Andrew M. Dolinar
*Attorney, Agent, or Firm*—Craig and Antonelli

[57] ABSTRACT

A control system for the internal combustion engine comprises means for detecting the flow rate of air sucked into the engine, as an electrical signal, means for detecting the number of revolutions of the engine, a sensor for sensing the oxygen concentration in the engine exhaust gas, a fuel injector for injecting fuel into the path of air sucked into the engine, in synchronism with the rotational angle of the engine at the required injection timing, and control means for controlling the fuel injection timing of the injector on the basis of the air flow rate signal from the air flow rate detector means, the number-of-revolutions signal from the number-of-revolutions detector means and the air-fuel ratio signal from the oxygen sensor. Under the normal operating conditions, the control means stores in a register the air flow rate signal, the number-of-revolutions signal and injection time at a given time point; judges that the signal from the oxygen sensor is within the level corresponding to the theoretical air-fuel ratio during a period longer than the air-fuel ratio transmission delay time of the fuel injector and the oxygen sensor; calculates the air-fuel ratio from the air flow rate signal, the number-of-revolutions signal and the injection time stored in the register; and stores in a memory an air-fuel ratio correction factor which is the ratio between said calculated air-fuel ratio and the initial air-fuel ratio stored already. These processes are repeated a number of times. Under the special operating conditions, the control means reads out the air-fuel ratio suitable for a particular special operating condition and controls the injection time on the basis of the air-fuel ratio obtained by correcting the read-out air-fuel ratio by the air-fuel ratio correction factor.

10 Claims, 4 Drawing Figures

CONTROL SYSTEM FOR INTERNAL COMBUSTION ENGINE

BACKGROUND OF THE INVENTION

This invention relates to a control system for the internal combustion engine or more in particular to an electronically controlled fuel supply system for controlling the amount of fuel supply by measuring the flow rate of air sucked into the engine.

Generally, in an electronically controlled fuel supply system, fuel is supplied into the air path leading to the engine by a fuel injector, which includes an injection valve opened in synchronism with the engine rotation and kept open for a predetermined period of time. This valve-open period is the fuel injection time regulated by the electronically controlled fuel supply system in such a manner as to attain a predetermined air-fuel ratio for the amount of air sucked in. Theoretically, the air-fuel ratio is controlled to obtain the theoretical air-fuel ratio at which oxygen held in the sucked air and injected fuel is used for combustion in proper quantities. The precision of air-fuel ratio depends on the detection accuracy of a sucked air flow rate sensor and the response accuracy of the fuel injection valve. These accuracies of detection and response change with time after a protracted use of the engine. Therefore, accurate control is impossible merely by controlling the fuel injection time against the sucked air flow rate in such a manner as to attain a certain fixed air-fuel ratio.

In order to eliminate the above-mentioned disadvantage, a system has been commercialized by which the oxygen concentration in the exhaust gas from the engine is detected and the fuel injection time against the sucked air flow rate is controlled in such a manner that the detected oxygen concentration corresponds to the theoretical air-fuel ratio. This system takes advantage of the fact that the oxygen concentration of the exhaust gas is sharply reduced with the increase in the air-fuel ratio in the neighbourhood of the theoretical air-fuel ratio. The oxygen concentration in the exhaust gas is generally detected by an oxygen sensor including an air-permeable zirconia solid electrolyte. This control system generally employs a closed loop and therefore is effective in control to hold the engine operating condition at the theoretical air-fuel ratio. When the engine is required to be operated in the condition displaced from the theoretical air-fuel ratio as in the automobile warm-up, acceleration, running up or down a comparatively steep slope or along a freeway, however, such a control system cannot maintain the proper operating condition, since it is necessary to operate the engine with the mixture gas whose the fuel concentration is thicker or thinner than the theoretical air-fuel ratio. Further, when the air flow rate is sharply changed, such a control system cannot maintain the proper operating condition, since the time lag in which the air-fuel ratio information is transferred from oxygen sensor to injection valve is too long. In such special operating conditions, the closed loop control based on the data of the theoretical air-fuel ratio from the oxygen sensor is impossible, so that an open loop control is employed in which control is based on a predetermined air-fuel ratio determined as suitable for each of the above-mentioned special operating conditions. In such an open loop control, it is quite impossible to correct the change with time of the functions or response of the air flow rate sensor or injector. In such special operating conditions, therefore, neither fuel consumption is saved nor exhaust gas is purified properly and smoothly.

SUMMARY OF THE INVENTION

An object of the present invention is to provide a control system for the internal combustion engine in which the air-fuel ratio of the mixture gas sucked into the engine is controlled on the basis of the data of the theoretical air-fuel ratio detected by the oxygen sensor under the normal operating conditions, the data of the air-fuel ratio for the normal operating conditions is stored in a memory, and the air-fuel ratio is controlled under the special operating conditions by correcting the air-fuel ratio on the basis of the stored data.

Another object of the invention is to provide a control system for the internal combustion engine in which the air-fuel ratio of the mixture gas in the control system according to the first-above written object is controlled in accordance with the ranges of magnitude of the sucked air flow rate under the special operating conditions.

DETAILED DESCRIPTION OF THE PREFERRED EMBODIMENTS

Figure 1:
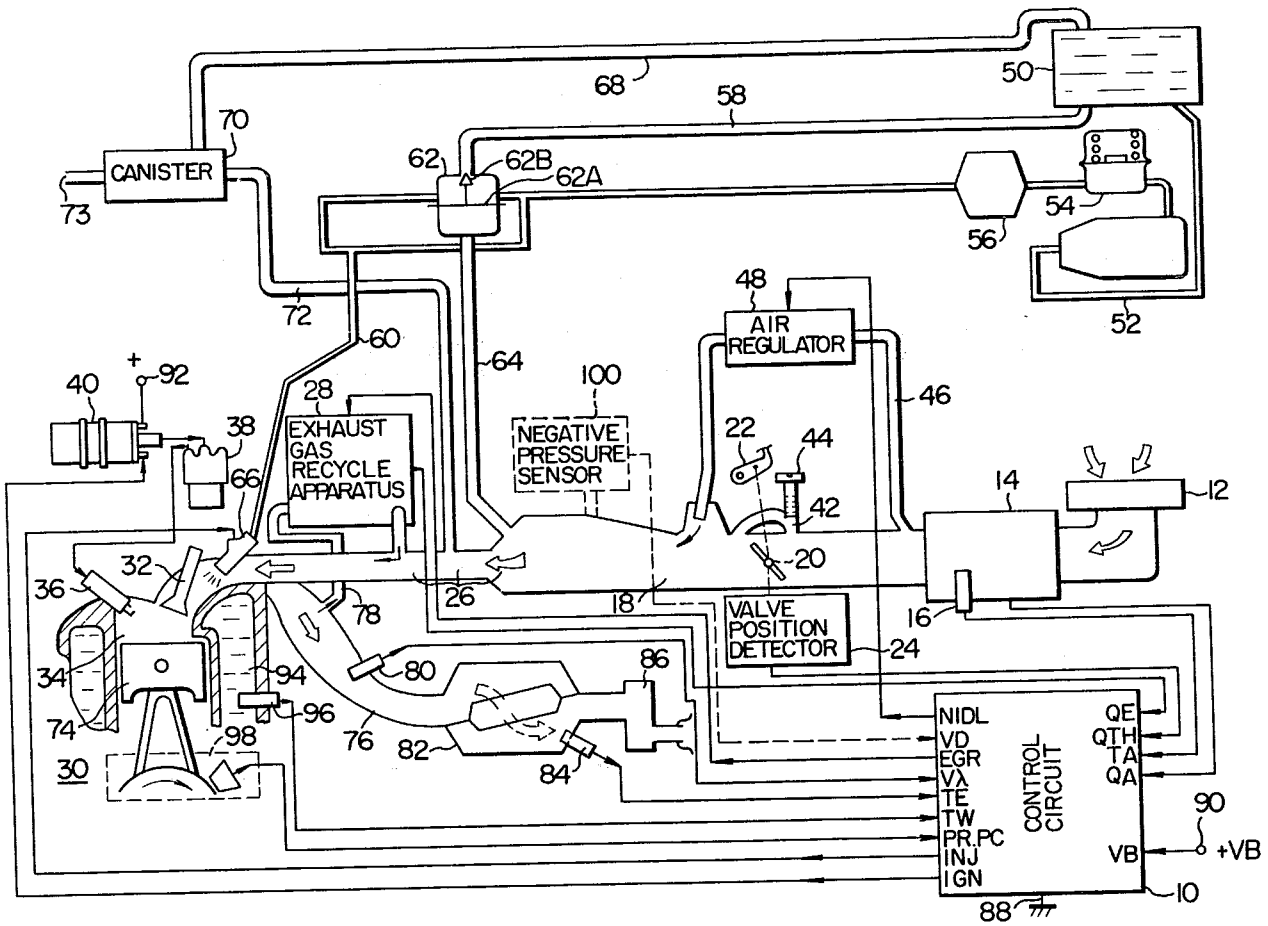
FIG. 1 is a diagram for explaining the general configuration of the control system for the internal combustion engine according to the present invention.

A configuration of the essential parts of the electronic engine control system is shown in FIG. 1. The air taken in through an air cleaner 12 is applied to an air flow meter 14, where the flow rate thereof is measured. An output QA representing the air flow rate is supplied from the flow meter 14 to a control circuit 10. The air flow meter 14 includes a sucked air temperature sensor 16 for detecting the temperature of the sucked air. The sensor 16 produces an output TA representing the temperature of the sucked air, which is applied to the control circuit 10.

The air that has passed the air flow meter 14 is then passed through the throttle chamber 18. The amount of air passing the throttle chamber 18 is controlled by changing the opening of the throttle valve 20 in the throttle chamber 18 and mechanically interlocked with the accelerating pedal 22. The valve position detector 24 detects the opening of the throttle valve 20 by detecting the position of the throttle valve 20. The signal QTH representing the position of the throttle valve 20 is applied from the throttle position detector 24 to the control circuit 10. The air that has passed the throttle chamber 18 is sucked into the combustion chamber 34 through the intake manifold 26 and the suction valve 32. Thus the amount of air sucked into the combustion chamber 34 is regulated by the accelerating pedal 22.

The throttle chamber 18 includes a bypass 42 for idling and an idle adjust screw 44 for regulating the amount of air flowing through the bypass 42. While the engine is idling, the throttle valve 20 is closed up. The sucked air from the air flow meter 14 flows through the bypass 42 and is sucked into the combustion chamber 34. The amount of sucked air when the engine is idling, therefore, may be changed by operation of the idle adjust screw 44. The energy generated at the combustion chamber 34 is substantially determined by the amount of air flowing in from the bypass 42, and therefore, the engine rotational speed under the idling state is adjusted at proper value by changing the amount of sucked air into the engine by regulating the idle adjust screw 44.

The throttle chamber 18 further includes another bypass 46 and the air regulator 48. The air regulator 48 regulates the amount of air passing through the path 46 in response to the output signal NIDL of the control circuit 10 so as to regulate the amount of air supplied to the engine in accordance with the control response of the fuel injection when the engine is under warm-up state or when the throttle valve 20 undergoes a sudden change or especially when it is closed suddenly. Also, the air flow rate at the time of idling may be changed if required.

Next, the fuel supply system will be described. The fuel stored in the fuel tank 50 is sucked by the fuel pump 52 and supplied under pressure to the fuel damper 54. The fuel damper 54 absorbs the pressure pulsation of fuel from the fuel pump 52 and supplies fuel of predetermined pressure to the fuel pressure regulator 62 through the fuel filter 56. The fuel from the fuel pressure regulator 62 is supplied under pressure to the fuel injector 66 through the fuel pipe 60. In response to the output INJ of the control circuit 10, the injection valve of the fuel injector 66 opens and fuel is injected.

The amount of fuel injected from the fuel injector 66 is determined by the valve open time of the injector 66 and the difference between the pressure of the fuel supplied to the injector and the pressure in the intake manifold 26 into which fuel is injected. The amount of fuel injected from the fuel injector 66, however, preferably depends solely on the valve open time determined by the signal produced by the control circuit 10. Thus the pressure of the fuel supplied by the fuel pressure regulator 62 to the fuel injector 66 is controlled in such a manner that the pressure difference between the fuel to the fuel injector 66 and the intake manifold 26 is kept constant. The fuel pressure regulator 62 includes a diaphragm 62A operated in response to the pressure difference on both sides thereof and a needle adjust valve with the valve body 62B fixed to the diaphragm 62A for adjusting the flow rate of fuel returned to the fuel return pipe 58. One of the chambers of the fuel pressure regulator 62 is supplied from the fuel pump 52 with fuel of a pressure slightly higher than proper fuel pressure, while the other chamber thereof is impressed with the intake manifold pressure through the conduction pipe 64. When the fuel pressure in the fuel pipe 60 exceeds a predetermined level as compared with the intake manifold pressure, the fuel pipe 60 communicates with the fuel return pipe 58, so that fuel corresponding to the excess pressure is returned to the fuel tank 50 through the fuel return pipe 58. In this way, the difference between the fuel pressure in the fuel pipe 60 and the manifold pressure in the intake manifold is kept constant.

The fuel tank system 50 further includes a pipe 58 for absorbing the gasified fuel and a canister 70. While the engine is running, air is sucked from the atmospheric opening and the fuel gas thus absorbed is introduced to the intake manifold 26 by the pipe 72. When the engine is stationary, on the other hand, the fuel gas is discharged into atmosphere through activated carbon.

As explained above, the fuel is injected from the fuel injector 66 and the suction valve 32 is opened in synchronism with the motion of the piston 74, thus introducing the air-fuel mixture gas to the combustion chamber 34. By compression and the resulting combustion of this mixture gas by the spark energy from the ignition plug 36, the combustion energy of the mixture gas is converted into kinetic energy for operating the piston.

The combusted mixture gas is discharged as an exhaust gas into the atmosphere through an exhaust valve (not shown), the exhaust tube 76, the catalyst converter 82 and the muffler 86. The exhaust tube 76 includes the exhaust gas recycle tube 78 through which part of the exhaust gas is led to the intake manifold 26. In other words, part of the exhaust gas is returned to the suction side of the engine. The amount of exhaust gas thus returned is determined by the degree of opening of the valve of the exhaust gas recycle apparatus 28. The degree of valve opening is controlled by the output EGR of the control circuit 10. The valve position of the exhaust gas recycle apparatus 28 is converted into an electrical signal and in the form of signal QE, applied to the control circuit 10. The amount of nitrogen oxide contained in the exhaust gas increases in proportion to the combustion temperature in the cylinders. Therefore, the amount of oxygen is required to be reduced if the combustion temperature is to be reduced. For this purpose, water, methanol or carbon dioxide is mixed with the sucked air. The exhaust gas recycle apparatus 28 so operates that the exhaust gas most of which comprises carbon dioxide is mixed with the sucked air, thus reducing the combustion temperature in the combustion chamber.

The exhaust tube 76 includes a λ sensor 80 for detecting the mixing ratio of mixture gas sucked into the combustion chamber 34. This λ sensor 80 generally takes the form of oxygen sensor ($O_2$ sensor) and, detecting the oxygen concentration in the exhaust gas, generates a voltage Vλ corresponding to the oxygen concentration. The output Vλ of the λ sensor 80 is applied to the control circuit 10. The catalyst converter 82 includes an exhaust gas temperature sensor 84, so that the output TE corresponding to the exhaust gas temperature is applied to the control circuit 10.

The control circuit 10 has a negative power terminal 88 and a positive power terminal 90. From the control circuit 10, the signal IGN for controlling spark generation of the ignition plug 36 as mentioned above is applied to the primary winding of the ignition coil 40. A high voltage thus produced at the secondary winding is applied through the distributor 38 to the ignition plug 36, thereby generating a spark for combustion in the combustion chamber 34. More specifically, the ignition coil 40 has a positive power terminal 92, and the control circuit 10 has a power transistor for controlling the primary winding current of the ignition coil 40. A series circuit including the primary winding of the ignition coil 40 and the power transistor is formed between the positive power terminal 92 of the ignition coil 40 and the negative power terminal 88 of the control circuit 10. By the turning on of the power transistor, electromagnetic energy is stored in the ignition coil 40, while by the turning off of the power transistor, the electromagnetic energy is applied to the ignition plug 36 as energy of high voltage.

The engine 30 has a water temperature sensor 96 for detecting the temperature of the engine cooling water 94. The water temperature sensor 96 applies the signal TW associated with the detected temperature to the control circuit 10. Further, the engine 30 has an angle sensor 98 for detecting the rotational angle of the engine. The sensor 98 produces a reference signal PR every 120 degrees of engine rotation in synchronism with engine rotation, and an angular signal PC at each predetermined angle, for instance, 0.5 degrees, of engine rotation. These signals are applied to the control circuit 10. The number of revolutions of the crankshaft is easily determined from the reference signal PR.

In FIG. 1, the air flow meter 14 may be replaced with a negative pressure sensor. In the drawing, such a negative pressure sensor is shown by a dotted line, and applies to the control circuit 10 a voltage VD corresponding to the negative pressure of the intake manifold 26.

Specifically, the negative pressure sensor 10 may take the form of a semiconductor negative sensor. The boost pressure of the intake manifold is caused to act on one side of the negative pressure sensor and the atmospheric pressure or a fixed pressure on the other side thereof. Such a pressure may be vacuum. In such a construction, the voltage VD proportional to the manifold pressure is generated by the piezo resistance effect or like and applied to the control circuit 10.

Figure 2:
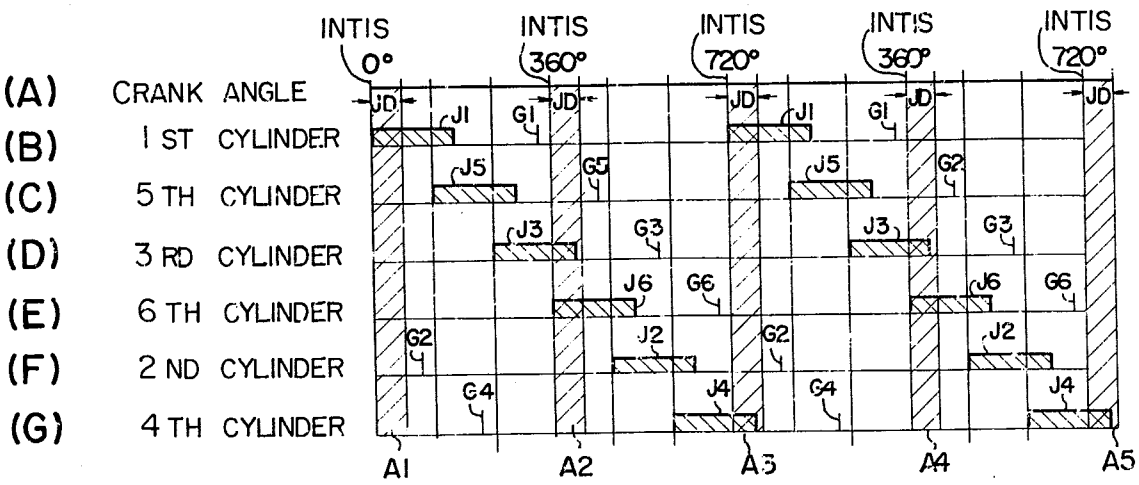
FIG. 2 is a diagram for explaining the relation in timing between fuel injection and the operating condition of each engine cylinder as related to the rotational angle of the crank shaft.

The diagram of FIG. 2 is for explaining the ignition timing as relative to the crank angle of the six-cylinder engine and the fuel injection timing. (A) shows the crank angle. A reference signal PR is produced from the angle sensor 98 each 120 degrees of crank angle. In response to this signal, the control circuit 10 produces a signal at the crank angles of 0°, 120°, 240°, 360°, 480°, 600° and 720°.

In the drawing under consideration, (B), (C), (D), (E), (F) and (G) show the operation of the first, fifth, third, sixth, second and fourth cylinders respectively. J1 to J6 show the opening positions of the suction valves of the respective cylinders. The valve opening positions of the cylinders are displaced by 120 degrees of the crank angle T as shown in FIG. 2. Somewhat depending on the engine structure, the valve opening positions and the valve opening width are substantially reflected in the drawing.

In the drawing, A1 to A5 show the valve open timing of the fuel injector 66, i.e., the fuel injection timing. The length JD of the respective injection time A1 to A5 represent the valve open time of the fuel injector 66. This time length JD may be considered to represent the amount of fuel injection from the fuel injector 66. The fuel injector 66 is provided for each cylinder and connected in parallel to the drive circuit in the control circuit 10. In response to the signal INJ from the control circuit 10, the fuel injector for each cylinder opens the valve thereof simultaneously for fuel injection. The signal INJ is for determining the pulse width of the fuel injection.

Explanation will be made below of the first cylinder shown in (B) of FIG. 2. In synchronism with the reference signal INTIS generated at the crank angle of 360 degrees, the output signal INJ from the control circuit 10 is applied to the fuel injector 66 provided at the intake port or manifold of each cylinder. As a result, fuel is injected as shown by A2 for the time period JD calculated by the control circuit 10. Since the suction valve of the first cylinder is closed, however, the injected fuel is held in the neighbourhood of the intake port of the first cylinder but not sucked into the cylinder. Next, in response to the reference signal INTIS generated at the crank angle of 720 degrees, a signal is applied from the control circuit 10 again to the respective fuel injectors 66, thus injecting fuel as shown by A3. Almost simultaneously with this injection, the suction valve of the first cylinder is opened so that both the fuel injected in A2 and fuel injected in A3 are sucked into the combustion chamber. The same applies to the other cylinders. Thus, in the fifth cylinder shown by (C), the fuel injected in A2 and A3 is sucked into the combustion chamber at the valve open position J5 of the intake valve. In the third cylinder shown by (D), part of the fuel injected in A2, fuel injected in A3 and part of the fuel injected in A2 are sucked into the combustion chamber at the open position J3 of the suction valve. The part of the fuel injected in A2 combined with the fuel part injected in A4 makes up the amount of fuel for one injection. Thus the amount of fuel for two injections is taken in each suction stroke of the third cylinder. Similarly, in the sixth, second and fourth cylinders shown in (E), (F) and (G), the amount of fuel corresponding to two injections of the fuel injector are sucked in a single suction stroke. As apparent from the foregoing explanation, the amount of fuel injected which is designated by the fuel injection signal INJ from the control circuit 10 is one half that of fuel required for suction, so that the amount of fuel commensurate with the air sucked into the combustion chamber 34 is obtained by two injections by the fuel injector 66.

In FIG. 2, G1 to G6 show ignition timings for the first to sixth cylinders. By turning off the power transistor in the control circuit 10, the current in the primary side of the ignition coil 40 is cut off, thus generating a high voltage in the secondary coil thereof. This high voltage is generated in timing with the ignition timings G1, G5, G3, G2 and G4, and distributed to the ignition plug 36 of each cylinder through the distributor 38. Thus the ignitions plugs of the first, fifth, third, sixth, second and fourth cylinders are started in that order, thus combusting the mixture gas of fuel and air.

Figure 3:
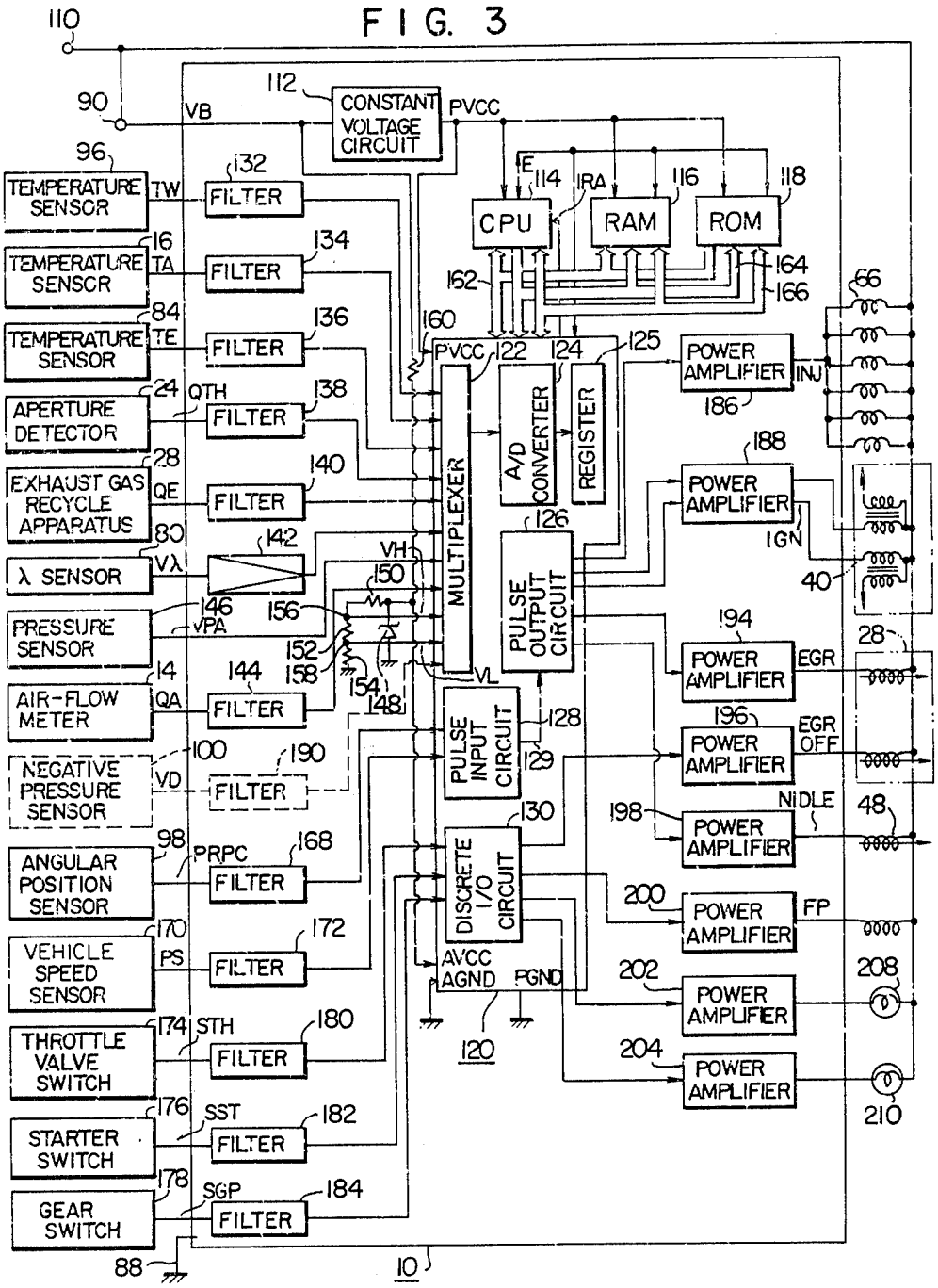
FIG. 3 is a block diagram showing in detail the control circuit shown in FIG. 1.

The detailed circuit configuration of the control circuit 10 of FIG. 1 is shown in FIG. 3. The positive power terminal 90 of the control circuit 10 is connected to the positive terminal 110 of the battery, so that a voltage VB is supplied to the control circuit 10. The source voltage VB is kept at constant voltage PVCC, say, 5 V, by the constant voltage circuit 112. This constant voltage PVCC is applied to the central processor (hereinafter referred to as CPU) 114, the random access memory (hereinafter referred to as RAM) 116, and the read only memory (hereinafter referred to as ROM) 118. Further, the output PVCC of the constant voltage circuit 112 is applied to the input/output circuit 120.

The I/O circuit 120 includes a multiplexer 122, an analog-to-digital converter 124, a register 125, a pulse output circuit 126, a pulse input circuit 128 and discrete I/O circuit 130.

The multiplexer 122 is impressed with an analog signal. In response to a command from CPU, one input signal is selected and applied to the A/D converter 124. The analog input signals QA applied to the multiplexer 122 via the filters 134, 136, 138, 140 and 144 include the analog signal TW representing the temperature of the engine cooling water, the analog signal TA indicating the temperature of the sucked air, the analog signal TE showing the temperature of exhaust gas, the analog signal QTH indicating the throttle opening, the analog signal QE showing the valve open state of the exhaust gas recycle apparatus 28, the analog signal Vλ representing the oxygen concentration of exhaust gas, i.e., the excess air in the sucked mixture gas and the analog signal QA showing the amount of air sucked in, which are produced from the water temperature sensor 96, the sucked air temperature sensor 16, the exhaust gas temperature sensor 84, the throttle position detector 24, the exhaust gas recycle apparatus 28, the λ sensor 80 and the air flow meter 14 shown in FIG. 1, respectively. The output Vλ of the λ sensor 80, however, is low in voltage level and therefore applied to the multiplexer through the amplifier 142 having a filter circuit.

Also, the analog signal VPA representing the atmospheric pressure, which is produced from the atmospheric pressure sensor 146, is applied to the multiplexer 122. The voltage VB is applied to the series circuit including the resistors 150, 152 and 154 through the resistor 160, from the positive power terminal 90. The voltage across the series circuit of the resistors is maintained constant by the zener diode 148. The voltages VH and VL at the junctions points 156 and 158 between the resistors 150 and 152 and between the resistors 152 and 154 respectively are applied to the multiplexer 122.

The above-mentioned CPU 114, RAM 116, ROM 118 and I/O circuit 120 are connected with each other by the data bus 162, address bus 164 and control bus 166. Further, clock signals E are applied from CPU to RAM, ROM and I/O circuit 120, so that data is transmitted via the data bus 162 in synchronism with the clock signal E.

The multiplexer 122 of the I/O circuit 120 is impressed with the water temperature signal TW, sucked air temperature signal TA, exhaust gas temperature signal TE, throttle opening signal QTH, exhaust gas recycle rate signal QE, λ sensor output Vλ, atmospheric pressure signal PVA, reference voltages VH and VL and the sucked air amount signal QA or negative pressure signal VD. The addresses of these inputs are designated by the CPU 114 through the address bus according to the command program stored in ROM 118, so that the analog input of the addresses designated is taken in. This analog input is applied from the multiplexer 122 to the analog-to-digital converter 124. The digitally converted value is held in the register 125 corresponding to the respective inputs, and then applied to CPU 114 or RAM 116 in response to the command sent from CPU 114 via the control bus 166, as required.

The reference pulse P and the angle signal PC in the form of pulse train are applied from the angle sensor 98 to the pulse input circuit 128 through the filter 168. Further, the pulses PS of the frequency corresponding to the vehicle speed are applied from the vehicle speed sensor 170 to the pulse input circuit 128 through the filter 172.

The signal processed by CPU 114 is held in the pulse output circuit 126 having the functions of a register. One of the outputs of the pulse output circuit 126 is applied to the power amplifier circuit 186, on the basis of which the fuel injector is controlled.

Reference numerals 188, 194 and 198 show power amplifier circuits for controlling the current in the primary side of the ignition coil 40, the opening of the exhaust gas recycle apparatus 28 and the opening of the air regulator 48 in response to the output pulses from the pulse output circuit 126. The discrete I/O circuit 130 receives and holds, via the filters 180, 182 and 184, signals from the switch 174 for detecting the closed-up state of the throttle valve 20, the starter switch 176 and the gear switch 178 indicating that the transmission gear is in "top speed" position, respectively. Further, the processed signal from the central processing unit CPU 114 is held. The signal associated with the discrete I/O circuit 130 is one capable of indicating the content thereof by one bit. In response to the signal from the central processing unit CPU 114, signals are applied from the discrete I/O circuit to the power amplifier circuits 196, 200, 202 and 204 for such operations as closing the exhaust gas recycle apparatus 28 to stop exhaust gas recycle, control of the fuel pump, indication of an abnormal temperature of the catalyst on the lamp 208 and indication of engine overheated condition on the lamp 210.

The air-fuel ratio for the internal combustion engine is given as $$R \propto QA/nTi \quad (1)$$

where QA is a signal representing the amount of sucked air detected by the air flow sensor 14 in FIG. 1, n the number of engine revolutions determined by dividing the pulses obtained from the angle sensor 98, and Ti the injection pulse width corresponding to the open time of the injection valve of the fuel injector 66. From equation (1), the injection pulse width Ti is expressed as $$Ti \propto QA/nR \quad (2)$$

Under the normal operating condition of the internal combustion engine, the injection pulse width Ti is subjected to closed-loop control on the basis of the sucked air mount QA and number of revolutions n in such a manner that the theoretical air-fuel ratio Ro is attained, utilizing the fact that the output of the λ sensor 80 suddenly changes in the neighborhood of the theoretical air-fuel ratio. The sucked air mount QA is divided into five ranges from zero to maximum. The number of ranges into which QA is divided may alternatively be eight or more, as desired. The value of the right side Ro for a brand new vehicle which has not yet been driven in the streets after being manufactured in the factory is expressed as $$Ro = QA/nTi \quad (3)$$

The values QA, n and Ti change with time. The value Rti of the right side of equation (1) after such changes with time is give as $$Rti = QA/nTi \quad (4)$$

The ratio Ki between Rti and Ro for each range of the sucked air amount is $$Ki = Rti/Ro \quad (5)$$

For a brand new vehicle, Rti = Ro, and therefore Ki = 1. The value Ki is a correction factor for the change with time of the performance of the air flow meter 14 and injector 66.

Figure 4:
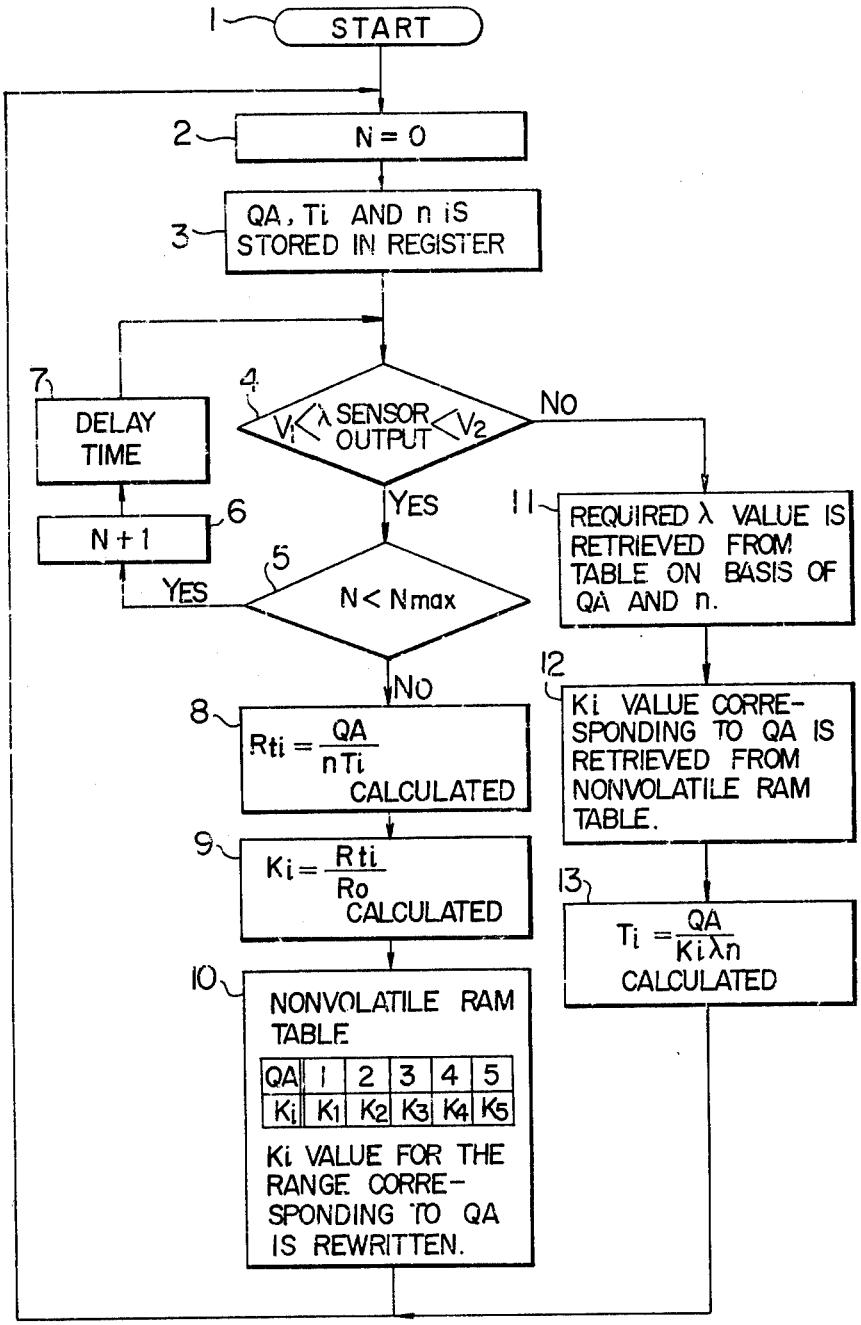
FIG. 4 is a flow chart for the control system according to the present invention.

A flow chart for explaining the operation of an embodiment of the present invention is shown in FIG. 4. RAM 116 includes a nonvolatile memory which keeps information in store even when power is thrown off. The step 1 of FIG. 4 is concerned with a brand new vehicle in the initial state having not yet experienced the driving in the streets. Under this condition, "1" is written in the memory sections $K_1$, $K_2$, $K_3$, $K_4$ and $K_5$ of the nonvolatile memory of RAM 116. At the same time, the value Ro is calculated by CPU 114 according to the program of ROM 118 and stored in RAM 116. In step 2, the continuous number N in RAM 116 stored in RAM 116 is set to "0".

The mixture gas of a certain air-fuel ratio comprised of sucked air and the fuel injected from the fuel injector 66 is combusted in the combustion chamber 34 and discharged into the exhaust gas tube 76. It requires approximately 100 msec on the average for the air at the injector 66 to reach the λ sensor 80. If normal operation continues during this period, the air-fuel ratio at the position of the injector 66 is considered identical to that before combustion of the exhaust gas at the position of the λ sensor 80. This air-fuel ratio is the theoretical one based on the output of the λ sensor 80. If normal operation is changed to a special operating condition or a special operating condition continues during the 100-msec period, on the other hand, the output of the λ sensor 80 indicates a value different from the theoretical air-fuel ratio and therefore the air-fuel ratio of the mixture gas at the position of the injector 66 is not the theoretical value.

Step 3 in FIG. 4 is such that the number of revolutions n, the injection pulse width and the sucked air amount QA for N=0 are stored in the corresponding memory sections of the register 125. In step 4, whether the engine is in normal operating condition or not is determined. Under the normal operating condition, the output of the λ sensor changes suddenly in the neighbourhood of the theoretical air-fuel ratio. When it is decided that the output of the λ sensor is within the range $V_1$ to $V_2$ corresponding to the theoretical air-fuel ratio, the engine is considered in the normal operating condition and advance is made to the next step 5.

It takes 100 msec for the gas to proceed from the injection position of the injector 66 to the λ sensor 80. After confirming that the normal operating condition continues for at least 100 msec, the values QA, Ti and n stored in step 3 may be processed as values giving the theoretical air-fuel ratio subjected to closed loop control. Assume that the continuous number N has the maximum value Nmax of 10. If 10 msec is set for one continuous number N, it takes 100 msec before N reaches 10. The period of N may be conveniently in proportion to the flow velocity in synchronism with engine rotation instead of being fixed. In step 5 in FIG. 4, whether or not the continuous number N has reached maximum Nmax is determined. If N is smaller than Nmax, "1" is added to N in step 6 and a delay time to attain 10 msec for one continuous number N is given in step 7, from which the process is returned to step 4. After that, a similar process from steps 4 to 7 is repeated. When N reaches Nmax in step 5, advance is made to step 8 where the values QA, Ti and n stored in the register 125 in step 3 are read out and the value Rti of equation (4) is calculated according to the program stored in ROM 118. In step 9, the value Ro is read out of the RAM 116 and value Ki is calculated according to equation (5). This value Ki is rewritten to the correction factor Ki for the range corresponding to the sucked air amount in step 10. The process is then returned to step 2 for repetition of a similar operation. In one operation from steps 2 to 10, the correction factor for only one of the five ranges of the sucked air amount is rewritten. Although the performance of the air flow meter 14 or injector 66 changes with time on the order of day or month, the correction factor table for the nonvolatile RAM is rewritten at time intervals on the order of second. Thus the table is rewritten sufficiently prior to the change with time of such devices. Instead of the sucked air amount QA, the negative pressure VD of the negative pressure sensor 100 may be used with equal effect.

If "No" is the answer at step 4, the engine is in a special operating condition, under which the air-fuel ratio is controlled at a value different from the theoretical ratio. In warm-up, acceleration or driving up a slope, for example, the air-fuel ratio is reduced below the theoretical value; while in deceleration or driving down a slope, the air-fuel ratio is controlled at a larger value than the theoretical one. The 256 values (16×16) of air-fuel ratio λ corresponding to the number of revolutions n and the sucked air amount divided into 16 ranges are tabulated and stored in ROM 118. Under a special operating condition, the air-fuel ratio suitable for that operation is retrieved from the table of ROM 118 and the injection pulse width Ti based on the air-fuel ratio λ is determined from equation below.

$$Ti = QA/\lambda n \quad (6)$$

thus setting the injection time Ti. It should be noted that the value λ for the conventional systems is already set at the time of assembly of ROM 118 and therefore not corrected for any change with time of the sensors or other operating devices and that in the conventional systems, the air-fuel ratio is not controlled on the basis of the λ sensor under the special operating conditions where the system is subjected to open-loop control. According to the present invention, in spite of the open-loop control under the special operating conditions, the injection pulse width Ti is calculated from the equation (7) below $$T_1 = QA/Ki\lambda n \quad (7)$$

taking into consideration the correction factor Ki for the air-fuel ratio. It is thus possible to drive the vehicle under the special operating conditions at the air-fuel ratio intended in design stage, which has been corrected against the change with time of the performance of the air flow meter 14 and injector 66.

In other words, step 11 is one in which the air-fuel ratio associated with the special operating condition at the particular time is retrieved from the table of ROM 118 on the basis of the values of sucked air amount QA and number of revolutions n. This is followed by step 12 in which the correction factor Ki for the air-fuel ratio associated with the sucked air amount QA is retrieved from the nonvolatile memory section of RAM 116. In step 13, the injection pulse width Ti is calculated by CPU 114 from equation (7) according to the program stored in ROM 118, and the air-fuel ratio is controlled by open loop on the basis of the calculated value. For a special operating condition, the process is repeated by the loop including the steps 2, 3, 4, 11, 12, 13 and 2 processed in that order.

The value K is sufficiently approximate to unity or 1 in the well-adjusted air flow sensor or negative pressure sensor. For the sensor low in accuracy, however, the value K is distributed around unity. Also, the value K is corrected with time as required. This value K is read out in step 13 for correction of QA or (VD), and therefore a high accuracy is always assured for any sensor. Further, the nonvolatile table enables a corrected air-fuel to be set under a special operating condition, with an accuracy not adversely affected by the change of sensor. Furthermore, the vehicle engine is subjected to open loop control at the time of special operating condition, thus eliminating the problem of delay under transient condition.

According to the present invention, the air-fuel ratio is not determined by the accuracy of the air flow rate detector or negative pressure sensor only but always corrected by the λ sensor, with the result that a highly accurate control is always assured.

We claim:

1. A control system for the internal combustion engine, comprising:

sucked air flow rate detector means for detecting an electrical signal related to the flow rate of the air sucked into the internal combustion engine, number-of-revolutions detector means for detecting the number of revolutions of said engine, air-fuel ratio detector means for detecting the air-fuel ratio of the mixture gas sucked into said engine as an electrical signal related to said air-fuel ratio, fuel supply means for supplying fuel into the path of the air sucked into said engine, and control means for supplying a control signal to said fuel supply means for controlling the quantity of fuel supplied by said fuel supply means, on the basis of an air flow rate signal produced from said sucked air flow rate detector means, a number-of-revolutions signal detected by said number-of-revolutions detector means and an air-fuel ratio signal detected by said air-fuel detector means;

said control means further comprising:

an air-fuel ratio correction factor control section including a first memory means for storing said air flow rate signal, said number-of-revolutions signal and the control signal supplied to said fuel supply means, in a repetition period longer than the delay time of transmission of the air-fuel ratio between said fuel supply means and said air-fuel ratio detector means, said air-fuel ratio correction factor control section judging that said air-fuel ratio signal is maintained within a predetermined level range for the period longer than said air-fuel ratio transmission delay time within said repetition period from the time of said storage in said first memory means, said control section calculating the air-fuel ratio, when the air-fuel ratio signal is maintained within said level range longer than said delay time, as a function of said control signal and the ratio between said air flow rate signal and said number-of-revolutions signal stored in said first memory means, said control section including a second means for storing an air-fuel ratio correction factor which is the ratio between said calculated air-fuel ratio and an initial air-fuel ratio stored already in said second memory means, and a special operation control section for reading out from said second memory means, when said engine is under a special operating condition, an air-fuel ratio stored therein suitable for said special operating condition, said special operation control section controlling the quantity of fuel from said fuel supply means on the basis of an air-fuel ratio obtained by correcting said read-out air-fuel ratio according to said air-fuel ratio correction factor.

2. A control system for the internal combustion engine according to claim 1, in which said air-fuel ratio correction factor control section divides said air flow rate into a plurality of ranges and stores an air-fuel correction factor for each of said range, said special operation control section correcting said air-fuel ratio by reading out the air-fuel ratio correction factor corresponding to the air flow rate under a particular special operating condition.

3. A control system for the internal combustion engine according to claim 1 or 2, in which said special operation control section divides said air flow rate and said number of revolutions into a plurality of ranges and tabulates and stores in said second memory means an air-fuel ratio suitable for the special operating condition associated with each of said ranges, said control section retrieving an air-fuel ratio from the table in said second memory means on the basis of the air flow rate and the number of revolutions under a particular special operating condition.

4. A control system for the internal combustion engine according to claim 1, in which said repetition period for said air-fuel ratio correction factor control section is in synchronism with the rotation of said engine.

5. A control system for the internal combustion engine according to claim 1 or 2, in which said fuel supply means injects fuel at an injection time controlled by said control means in synchronism with the rotational angle of said engine, and the air-fuel ratio calculated by said air-fuel ratio correction factor control section is given as a function of QA/nTi, where QA is the value representing said stored air flow rate signal, n the value representing said stored number-of-revolutions signal and Ti the injection pulse width determining said injection time.

6. A control system for the internal combustion engine according to claim 5, in which said injection pulse width Ti controlled on the basis of the air-fuel ratio corrected by said special operation control section is given as a function of QA/Kλn, where λ is the read-out air-fuel ratio suitable for a particular special operating condition and K the air-fuel ratio correction factor.

7. A control system for the internal combustion engine according to claim 1, in which said sucked air flow rate control means is a negative pressure sensor.

8. A control system for the internal combustion engine according to claim 1, in which said air-fuel ratio detector means is a λ sensor for detecting the oxygen concentration in the exhaust gas.

9. A control system for the internal combustion engine according to claim 3, in which said fuel supply means injects fuel at an injection time controlled by said control means in synchronism with the rotational angle of said engine, and the air-fuel ratio calculated by said air-fuel ratio correction factor control section is given as a function of QA/nTi, where QA is the value representing said stored air flow rate signal, n the value representing said stored number-of-revolutions signal and Ti the injection pulse width determining said injection time.

10. A control system for the internal combustion engine according to claim 9, in which said injection pulse width Ti controlled on the basis of the air-fuel ratio corrected by said special operation control section is given as a function of QA/Kλn, where is the read-out air-fuel ratio suitable for a particular special operating condition and K the air-fuel ratio correction factor.

* * * * *